US006676546B2

(12) United States Patent
Gordon

(10) Patent No.: US 6,676,546 B2
(45) **Date of Patent: *Jan. 13, 2004**

(54) GAME COURT FOR ELEVATED GOAL BALL GAME AND GAME PLAYED THEREON

(75) Inventor: Mason Gordon, Sherman Oaks, CA (US)

(73) Assignee: Time Warner Entertainment Company, L.P., New York, NY (US)

( * ) Notice: Subject to any disclaimer, the term of this patent is extended or adjusted under 35 U.S.C. 154(b) by 143 days.

This patent is subject to a terminal disclaimer.

(21) Appl. No.: 09/846,412

(22) Filed: May 1, 2001

(65) Prior Publication Data

US 2002/0010042 A1 Jan. 24, 2002

Related U.S. Application Data

(63) Continuation-in-part of application No. 09/619,136, filed on Jul. 18, 2000, now Pat. No. 6,488,600.

(51) Int. Cl.[7] ..... A63B 61/00

(52) U.S. Cl. ..... 473/490; 473/415

(58) Field of Search ..... 473/469, 490, 473/415, 477; 273/393; 482/28, 27, 29; 267/116

(56) References Cited

U.S. PATENT DOCUMENTS

| | | | | |
|---|---|---|---|---|
| 3,201,126 A | | 8/1965 | Nissen | |
| 3,233,895 A | * | 2/1966 | Grelle et al. | 482/27 |
| 3,312,471 A | * | 4/1967 | Nissen | 473/469 |
| 3,388,909 A | | 6/1968 | Woods | |
| 5,277,010 A | * | 1/1994 | Stephenenson et al. | 52/403.1 |
| 5,312,109 A | * | 5/1994 | Cagle | 473/446 |
| 5,624,122 A | | 4/1997 | Winkelhorn | |
| 5,833,557 A | * | 11/1998 | Cole | 473/472 |
| 5,934,679 A | * | 8/1999 | Strain et al. | 273/395 |
| 5,967,943 A | | 10/1999 | Rich | |
| 6,135,922 A | | 10/2000 | Nissen | |

FOREIGN PATENT DOCUMENTS

| | | |
|---|---|---|
| EP | 0 846 481 A2 | 6/1998 |
| FR | 2 561 698 A1 | 9/1985 |

OTHER PUBLICATIONS

Anchorage–YMCA—http://www.ymca.ak.org/ymca5.html–p. 1, 1996.*

Epinions–Wilson Jet Evolution:/www.epinions.com/spit–basketball–Wilson–Jet/Evolution/, Oct. 25, 2002.*

Somersault Web Page– 6 pages– www.somersault.co.at/eng/start.html— publication date– prior 1999.*

By Peter Hecht, "Putting New Life Into Fair", 1997 McClatchy Newspapers, Inc. Scaramento Bee, Metro Final, Aug. 15, 1997, p. B1.

By Todd R. Weiss, "Family Fun At Its Best Circus Evokes Laughter At Hershey", 1998 Lancaster Newspapers, Inc. Lancaster New Ear (Lancaster, PA), May 22, 1998, p. A–14.

(List continued on next page.)

*Primary Examiner*—Stephen Blau
*Assistant Examiner*—M. Chambers
(74) *Attorney, Agent, or Firm*—O'Melveny & Myers LLP

(57) ABSTRACT

A game court and method for playing a game thereon are disclosed. The game court comprises a playing surface suitably large for running and jumping players, having adjacent surface areas with distinctly different properties. A first area of the playing surface is substantially rigid and resilient, and suitable for bouncing a ball. Optionally, the first area of playing surface comprises a resiliently suspended floor. The second area is a deformable-elastic surface, such as a trampoline surface, that is tuned to greatly increase the heights that players may attain by jumping. The game court is optionally surrounded by a wall comprising at least a portion of the court boundary. A game for playing on the game court is disclosed, comprising a basketball-like game. The game court may also be used for other sports such as gymnastics or exhibition-style wrestling.

22 Claims, 4 Drawing Sheets

OTHER PUBLICATIONS

By Jennifer Taylor, "Indoor Sports Facility A Hit With Baseball Program", 1998 Paddock Publications, Inc. Chicago Daily Herald, Jul. 16, 1998, Fox Valley, p. 1.

By Jae–Ha Kim, "Ringling Bros. And Barnum & Bailey Circus", 1998 Chicago Sun Times, Inc. Chicago Sun Times, Nov. 5, 1998, Late Sports Final Edition, Section Features; Reviews; Overnight; p. 46.

* cited by examiner

GAME COURT FOR ELEVATED GOAL BALL GAME AND GAME PLAYED THEREON

RELATED APPLICATION

This application is a continuation-in-part of application Ser. No. 09/619,136, filed Jul. 18, 2000, now U.S. Pat. No. 6,488,600.

BACKGROUND OF THE INVENTION

1. Field of the Invention

The present invention relates to athletic ball games and game courts for ball games, and particularly to games and game courts, such as basketball, in which points are scored by placing a ball in contact with, in, or through an elevated goal.

2. Description of Related Art

The game of basketball is known and popular worldwide, and played in various different contexts according to various different rules. For example, basketball is played by children and others using improvised goals and playing surfaces, in various amateur leagues at widely disparate levels of organization and skill, and by highly skilled and compensated professionals. Many other people participate in the sport as spectators of professional and amateur games. Although played in widely different contexts and according to various different rules, the game of basketball has certain essential characteristics, that may be summarized as follows.

Each game of basketball is played on a relatively rigid and hard surfaced, open court using a single spherical resilient ball that may readily be bounced ("dribbled") on the court using a player's hand. The players are divided into opposing teams comprised of at least one player each, and each team seeks to score points by passing the ball through an elevated goal or "basket" placed at an end of the court. Only one team has possession of the ball at any given time, and only the team in possession of the ball may score a goal. Possession is exchanged by stealing the ball from the team in possession, or after a violation of rules or a goal by the team in possession. The rules prohibit carrying or kicking the ball and taking the ball out of the bounds of the court. The rules also generally prohibit physical contact between players, such as grabbing, tripping, tackling, or body-blocking another player. Players may move the ball about the court by running while dribbling the ball, or by passing to another player. Points are generally scored by throwing the ball into the basket, although a player with sufficient leaping ability can jump up and thrust the ball directly into the basket, thereby performing a "slam-dunk." Within this essential framework, the game of basketball has evolved into a well-developed participatory and spectator sport.

As a spectator sport, much of the appeal of basketball derives from the relatively rapid and continuous flow of the game, the display of athletic ability by individual players, and teamwork among players. The display of athletic ability and teamwork is particularly evident as a team drives the ball towards the basket in preparation for scoring a goal. Feints, spins, timed passes, and high jumps by offensive and defensive players generate great interest and excitement by spectators. Dramatic actions such as slam-dunks and blocked shots are particularly appreciated by a crowd of spectators. However, the extent to which players can create dramatic crowd-pleasing plays is limited by various factors, including the hardness of the surface on which the game is played, the lack of protective equipment worn by the players, and the rules of the game.

SUMMARY OF THE INVENTION

The present invention provides a ball game that is similar to basketball, but differs from basketball in several essential characteristics. The game according to the invention is played on a specially constructed game court, features of which are described herein. A round spherical ball like a basketball is used, but the ball may be modified by having a higher coefficient of restitution (i.e., more "bounce") than a regulation basketball. Players may wear protective equipment, such as helmets, kneepads, and elbow pads. Certain essential rules of basketball may be modified, as also described herein. The modified rules, in combination with the specially constructed court and new equipment, provide a game that has value as an interesting new game for entertaining and amusing spectators. In particular, the game according to the invention enhances some of the most crowd-pleasing aspects of basketball, while providing the audience with entirely new types of displays of athletic ability and teamwork that have not previously been available in the context of any game.

According to an aspect of the invention, a special court is provided for the game. The overall court comprises a substantially flat playing surface. The playing surface may be generally rectangular, and may resemble a basketball court in its overall dimensions. At least one elevated goal is present at an end of the court; in other embodiments, two elevated goals may be present at opposite ends of the court. The elevated goal may comprise a regulation goal used in professional basketball, or some other elevated target capable of registering a goal by the game ball. The goal (or each goal, if more than one goal is used) is elevated above the playing surface so that a goal cannot be scored by the players without throwing the ball or leaping upwards from the playing surface.

The playing surface of the special court is generally divided into two substantially co-planar areas having contrasting surface types. A first area has a substantially rigid surface that is sufficiently hard so that players may run over it while dribbling the ball in a manner similar to dribbling in basketball. Preferably, the playing surface of the first area is suspended on springs or other shock-absorbing devices, in a manner similar to floors used for sporting events such as some forms of wrestling and gymnastics. The first area may thus be better able to cushion the fall of players than the traditional hard playing surface of basketball, thereby encouraging players to perform more aggressive or riskier leaps and similar maneuvers. However, a spring-suspended floor will also tend to absorb energy from the game ball. Accordingly, if a spring-suspended floor is used, the coefficient of restitution of the ball is preferably increased to compensate for the energy absorbed by the floor. Using an ordinary basketball, a suitable coefficient of restitution may be achieved by increasing the inflation pressure of the ball. In the alternative, a differently constructed ball may be used.

A second area of the court has a deformable-elastic surface, such as a trampoline surface. The deformable-elastic surface is capable of storing kinetic energy from a falling inelastic body (such as human bodies) and re-directing the stored energy into upward movement of the body, i.e., the surface is energy-restorative. Such surfaces are familiar in the art of trampoline construction. By suitable reacting to the deformable-elastic surface, players may jump substantially higher than is possible from a rigid surface. Preferably, at least one deformable-elastic surface is located generally under and adjacent to each goal. Additional elastic surfaces may be placed at various other locations on the court.

Depending on how the court is constructed, it may be preferable to create a transition zone between the first and second court areas. For example, in an embodiment of the invention, an array of coil springs is used to suspend a membrane or fabric sheet from a frame around the periphery of a hole in the rigid surface, thereby providing a deformable-elastic surface. A relatively narrow transition zone comprising a pad preferably surrounds the sheet to cover the array of coil springs. Players preferably avoid stepping on the pad, which primarily serves to protect players from inadvertently contacting the coil springs.

The rules of the game preferably specify different allowable conduct on the first and second areas of the court. For example, more body contact between the players and a limited number of player bounces may be allowed on the deformable-elastic surface. Such rules generally encourage more dramatic player movements in the second court area and help achieve a more dynamic and fast moving game flow.

In an embodiment of the invention, the periphery of the court is surrounded by a wall. Unlike traditional basketball, there are preferably no sidelines (painted boundaries along the long edges of a rectangular court), and the wall is considered "in-bounds." Therefore, players may use the wall to bounce-pass to another player or back to themselves. The wall may be partially comprised of transparent plastic, similar to the wall used in a hockey arena, and is preferably between about six to twelve feet high. In addition, netting may be strung above the top of the wall to prevent balls (and given the aerial aspects of the game, perhaps even an occasional flying player) from passing into the crowd. The wall and the absence of sidelines eliminate most stoppages in the game due to out-of-bounds violations. In an embodiment of the invention, the baselines (boundaries along the short edges of a rectangular court) are retained. In addition, a padded area may be provided between the wall and baselines to protect players in the event of a fall from the deformable-elastic surfaces. Suitable doors are provided in the wall for entry and exit of players.

The game is modeled according to the essential rules of basketball, with the exception of certain modifications to increase the intensity and excitement of the game, such as, for example, the following. Generally, there is no stoppage of the game on account of rule violations or fouls, and no "free throws". Instead, a specified number of points are immediately awarded to the team against whom the foul is committed. Similar to hockey, players may be ejected for specified periods for flagrant fouls, forcing their team to play short-handed during the penalty period. For less flagrant fouls, the offender and the fouled player may face each other in a one-on-one attempt at a goal, analogous to a penalty shot in soccer or hockey. The "possession arrow" is generally not used, and players are permitted to more aggressively wrest the ball from the possession of an opposing player. Body contact is more liberally allowed, particularly in the second court areas having the deformable-elastic surface. Players are not permitted to linger on the deformable-elastic surfaces, such as by permitting only a specified number of bounces on the elastic surface before the player must leave. The game clock is generally not stopped during a period of play, and the "shot-clock" period, during which a team in possession of the ball must attempt a goal, is relatively short. Player substitutions are liberally allowed without stoppage of the game. Zone defensive schemes are generally not allowed. Each of the foregoing rules and other like rules may be used, individually or in various combinations, to create a more intense and exciting game in combination with the special game court disclosed herein.

It is further anticipated that certain of the rules described herein may also be adapted to increase the pace and excitement of a game played entirely on a hard, rigid surface, such as on prior art basketball courts. Accordingly, the invention is especially useful for attracting and retaining a loyal audience of spectators, such as, for example, a broadcast audience. Therefore, in an embodiment of the invention, a method for creating a broadcast of a game played on the game court is disclosed.

A more complete understanding of the game court and game played thereon will be afforded to those skilled in the art, as well as a realization of additional advantages and objects thereof, by a consideration of the following detailed description of the preferred embodiment. Reference will be made to the appended sheets of drawings which will first be described briefly.

DETAILED DESCRIPTION OF THE PREFERRED EMBODIMENT

The present invention provides a novel game court with adjacent resilient and energy restorative surfaces, and a related novel method of game play that is particularly suitable for use with the game court. In the detailed description that follows, like element numerals are used to identify like elements that appear in one or more of the figures.

Figure 1:
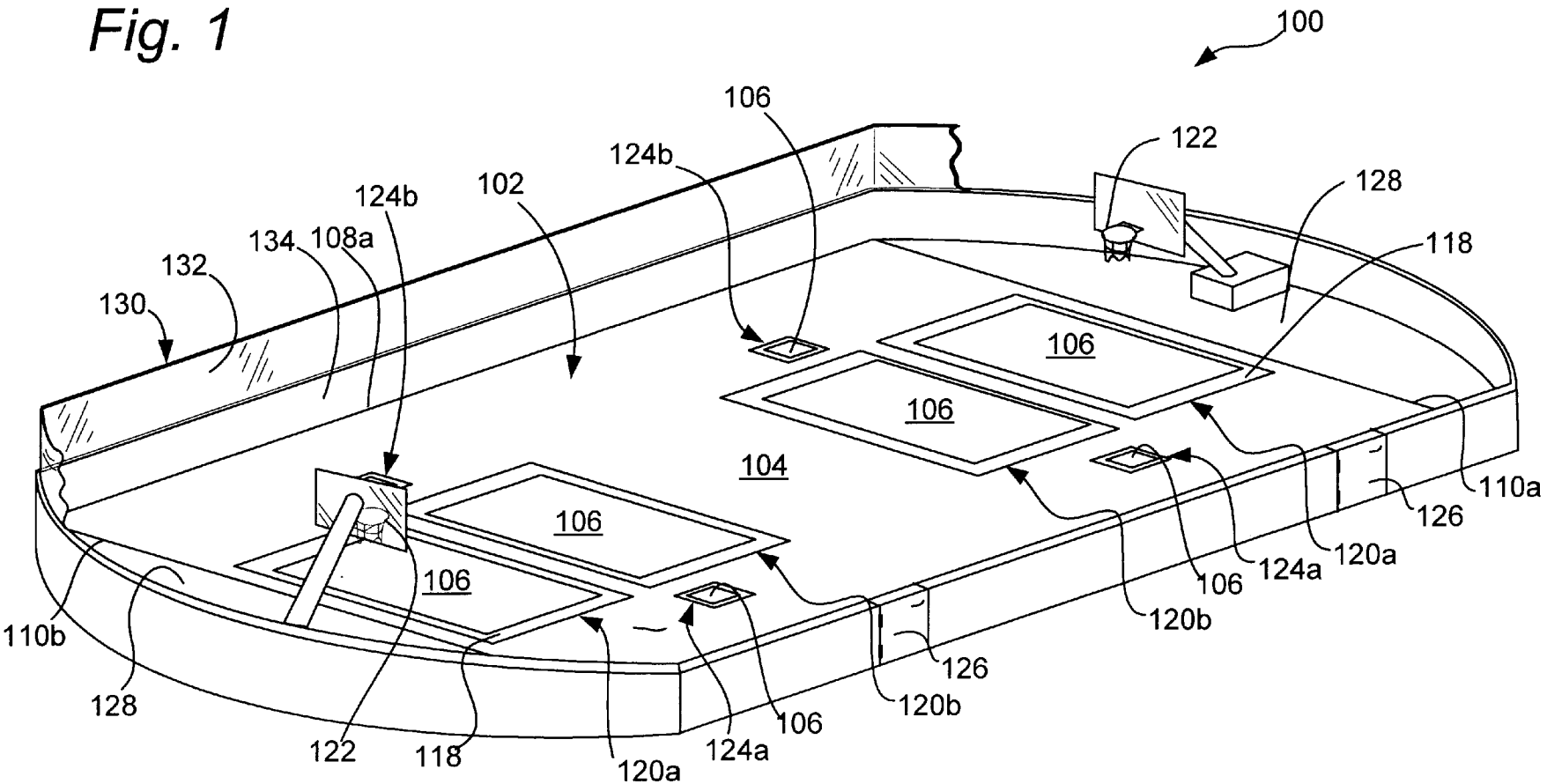
FIG. 1 is a perspective view of an exemplary special game court according to the present invention.
Figure 2:
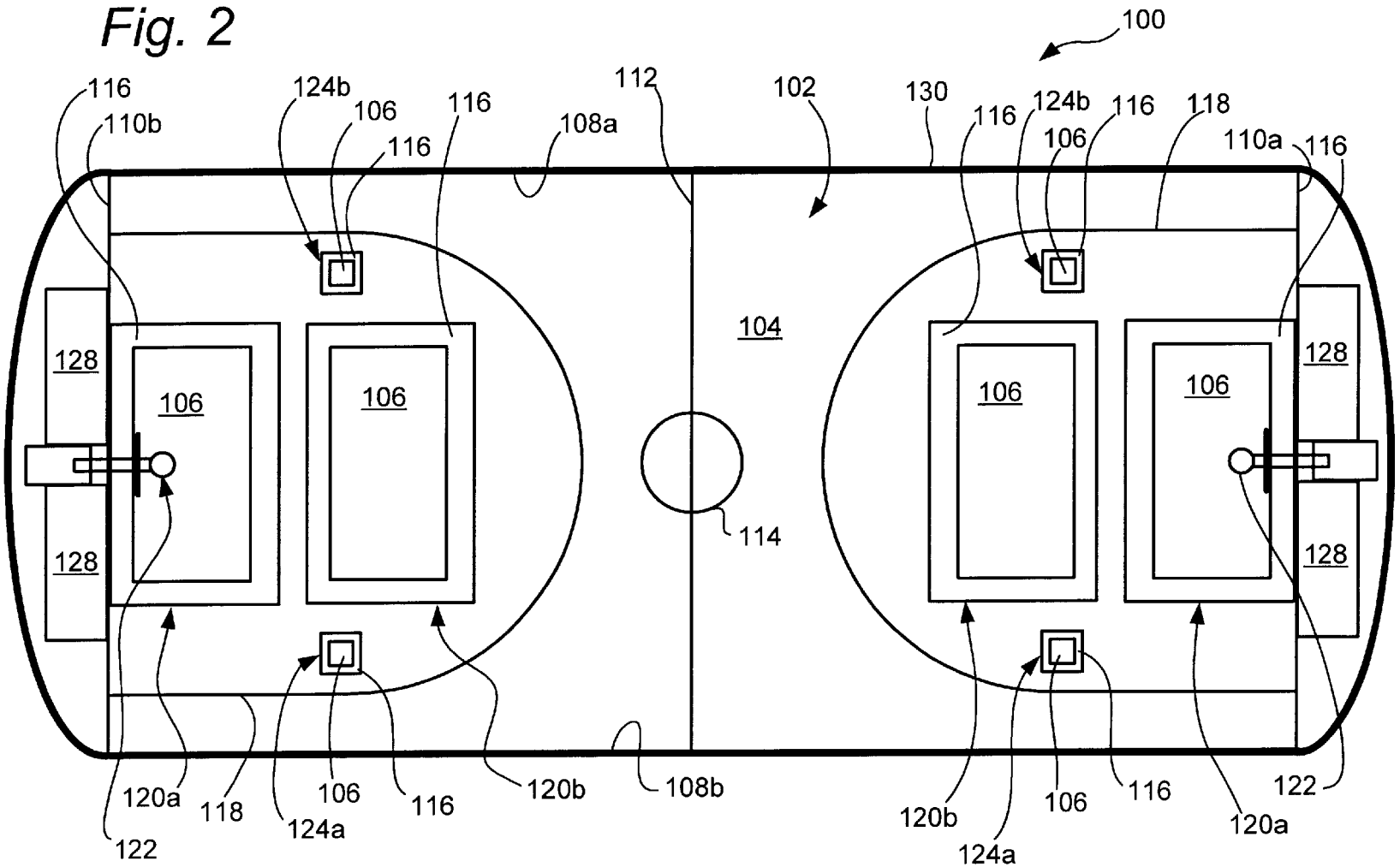
FIG. 2 is a plan view of the exemplary game court shown in FIG. 1.

FIG. 1 shows an exemplary game court 100 according to an aspect of the present invention, in perspective view. The same court 100 is shown in plan view in FIG. 2. A substantially flat (planar) playing surface 102 is a preferably aspect of the game court 100. Playing surface 102 may be generally rectangular, and may resemble a basketball court in its overall dimensions (e.g., 98 feet long by 48 feet wide), as shown in FIGS. 1 and 2, with opposing sidelines 108*a*, 108*b* and opposing baselines 110*a*, 110*b*. Optionally, the playing surface may be marked with a half-court line 112, distance scoring ("three-point") lines 118, and/or a center mark 114, shown in FIG. 2 only. Exemplary features of the playing surface are illustrated in rough proportion to the overall dimensions of the playing surface, and the invention is not limited to features having the shape, size, or proportions illustrated. For example, in the alternative, playing surface 102 may have any other flat shape of any size suitable for running and jumping players, including but not limited to a triangle, square, circle, pentagon, etc., and may be marked in any manner. The rectangular shape shown is especially suitable for playing a full-court game with two opposing teams, similar to professional basketball, but the invention is not limited thereby. Alternative shapes may be more suitable for half-court (single-goal) games or games with more than two goals and/or more than two teams.

However it may be shaped, sized, or proportioned, playing surface 102 is comprised of two distinctly different types of surfaces occupying adjacent areas of the overall surface 102. The first type of surface is a resilient surface 104, and the second type is a deformable-elastic surface 106. In the embodiment shown in FIGS. 1 and 2, surfaces 104 and 106 are substantially flat, parallel, and coplanar, and therefore the playing surface 102 is substantially flat. A substantially flat playing surface provides the advantages of preventing trips and falls by players and facilitating rapid movement between surfaces 104 and 106, while providing virtually unimpeded visual access to the entire playing surface from surrounding points in the audience. However, in alternative embodiments, surfaces 104 and 106 are not coplanar. For example, surface 106 may be recessed below surface 104, or in the alternative, raised above surface 104.

Resilient surface 104 preferably comprises a substantial portion of the area of playing surface 102, such as at least about 20%, and more preferably, at least about half. Resilient surface 104 may be any suitable surface such as used for traditional basketball courts, including but not limited to hardwood, plywood, plastic resin composite, concrete, or other flooring materials. Resilient surface 104 is preferably sufficiently hard and rigid to permit dribbling a conventional basketball with an amount of effort comparable to that required to dribble a basketball on a regulation basketball court. If surface 104 is too energy-absorptive, such as by being too flexible or too soft, the surface will absorb too much energy from a bouncing ball and from running players, making it difficult or impossible to play a basketball-style game. For example, most gym floor surface materials are sufficiently resilient, but soft carpeted or heavily cushioned surfaces are too energy-absorptive.

Resilient surface 104 may be rigidly supported, like the surface of a traditional basketball court. However, in the alternative, surface 104 may be resiliently suspended from or over a rigid frame. For example, in an embodiment of the invention, described in more detail later in the specification, resilient surface 102 comprises a resiliently suspended floor that is tuned to absorb relatively insubstantial energy from collisions with light elastic objects such as basketballs, and relatively substantial energy from collisions with heavier inelastic objects, such as human bodies. That is, surface 102 can be made more energy-absorptive (softer) in its reaction to falling players while still remaining relatively energy-reflective (resilient or hard) in its reaction to bouncing balls and running players. Such a tuned, resiliently suspended surface is especially preferred in combination with the deformable-elastic surfaces described herein. However, the tuned, resiliently suspended surface may also be used alone (without combining with a deformable-elastic surface). In either case, the resiliently suspended surface may reduce the incidence of injuries to players by absorbing impact energy from falling players.

The second type of surface comprising playing surface 102 is a deformable-elastic surface 106, such as a trampoline surface. Deformable-elastic surface 106 comprises substantially all of the remainder of the area of playing surface 102 not occupied by resilient surface 104, except for the relatively small, optional transition zones 118 between each area of deformable-elastic surface 106 and resilient surface 104. Transition zones 118 are primarily present to protect players from injury while permitting suitable operation of deformable-elastic surfaces 106, and are not otherwise considered desirable features of playing surface 102. To the extent it is possible to safely provide suitable deformable-elastic surfaces 106 without transition zones 118, such is preferred. However, with traditional trampoline surfaces, transition zones 118 may be needed to provide an area for unobstructed operation of the trampoline springs. The trampoline springs, in turn, may be covered by protective pads as a safety measure. Details of a suitable exemplary trampoline construction for providing deformable-elastic surfaces 106 are described later in the specification.

Some less traditional types of trampolines may use other elastic materials, instead of metallic springs, to suspend the trampoline surface and provide its needed elasticity. For example, the trampoline surface may be suspended by a plurality of elastic straps or bands that essentially replace the tension springs of a traditional trampoline. The elastic straps or bands may be positioned similarly to the tension springs in an array around the periphery of the trampoline membrane. One such non-traditional trampoline is the Airzone™ "springless" trampoline available from Variflex, Inc., of Moorpark, Calif. In the alternative, a continuous elastic strap or band may be attached around the entire periphery of the trampoline membrane. If one of these less traditional types of trampolines is used, corresponding changes may be made in the configuration of the transition zone. For example, it may be possible to reduce the amount of padding used over the transition zone, or in the alternative, if it is safe to step directly on the elastic suspension, to eliminate the padding altogether.

In an embodiment of the invention shown in FIGS. 1 and 2, the deformable-elastic surface 106 is arranged into paired rectangular areas 120*a–b* adjacent to each elevated goal 122. The paired arrangement is advantageous for providing separate bounce areas to an offensive player driving towards a goal 122 and for defending players. For example an offensive player may jump from surface 104 to area 120*b,* and from there directly to area 120*a,* attaining greater height with each leap. Also, a defender may bounce on area 120*a* while an offensive player is bouncing on area 120*b,* the defender timing his movements to meet the offensive player in mid-air. Secondary areas 124*a–b* of deformable-elastic surface may further be provided at various locations for launching onto one of the primary areas 120*a* or 120*b,* or to enhance certain offensive or defensive moves such as jump-shooting or shot-blocking.

Although a specific configuration of deformable-elastic surface has been described, and is believed to be advantageous in some respects, it should be appreciated that the invention is not limited thereby. An almost unlimited variety of other arrangements of deformable-elastic surface 106 in combination with resilient surface 104 are possible, without departing from the scope of the invention. For example, the primary deformable-elastic areas 120*a–b* may be merged into one area, or divided into more than two separate areas. Secondary areas 124*a–b* may be omitted, moved to other locations on the playing surfaces, or additional secondary areas may be provided. For further example, the shape of the deformable elastic areas, such as 120*a–b* and 124*a–b,* may be any alternative shape besides the square and rectangular shapes shown, such as triangular, pentagonal or higher-faceted polygonal, circular, or elliptical, without departing from the scope of the invention.

Each deformable-elastic surface 106 is preferably tuned to restore a substantial amount of kinetic energy to the bodies of the players that fall upon it. "Tuning" refers to constructing or adjusting the deformable-elastic surface so that its primary natural frequency corresponds (at least roughly) to the natural bounce frequency of the human players. The primary natural frequency of a trampoline surface, for example, depends primarily on the size of the trampoline membrane, the resting tension of the membrane, and the cumulative spring constant of the trampoline tension springs. A properly tuned deformable-elastic surface will absorb most of the energy of a falling player, and then restore most of this energy in its primary (first) rebound pulse at a speed and with a stroke length that allows the player to recapture the stored energy and build additional energy by pushing against the surface. If the surface has too low of a primary frequency, it will feel too soft and unresponsive, because it will not rebound quickly enough to keep up with the rebound speed required to propel the player upwards. If the surface has too high of a primary frequency, it will feel too hard and will outpace the players ability to push against it, i.e., it will oscillate more than once during the player's rebound leap. Factors which determine the primary frequency of the deformable-elastic surface are preferably accounted for during its design. Additional factors that should be considered are the additional load and interference effects caused by more than one player bouncing on a surface at one time, which may be particularly important for design of larger surfaces.

Methods for constructing a suitably tuned trampoline are known in the art. However, the invention is not limited to the use of a trampoline (whether traditional or non-traditional) to provide deformable-elastic surface 106. Other materials or methods of construction may be used. For example, it is conceived that a super-elastic, suitably strong and durable membrane, a bladder filled with an elastic fluid, or a super-elastic foam material can perform comparably to a trampoline, without the need for tension springs or separate elastic bands. To the extent that such materials exist or become available, they may alternatively be used to provide deformable-elastic surface 106.

At least one elevated goal 122 is present on game court 100; in other embodiments, two elevated goals may be present, such as at opposite ends 110*a* and 110*b* of the court. In an embodiment of the invention, the elevated goal comprises a regulation goal used in professional basketball. In the alternative, any other elevated target capable of registering a goal by the game ball may be used, such as, for example, an electronic target, or a vertical tube or pole wherein the goal comprises an open upper end of the tube or pole. However configured, the goal (or each goal, if more than one goal is used) is elevated above the playing surface so that a goal cannot be scored by the players without throwing the ball, carrying the ball while jumping upwards from the playing surface, or otherwise propelling the ball upwards from the playing surface.

In an embodiment of the invention, the periphery of game court 100 is surrounded by a wall 130. Unlike traditional basketball, there are preferably no sidelines (painted boundaries along the long edges of a rectangular court) and the wall (i.e., its interior surface facing playing area 102) is considered "in-bounds." Therefore, players may use the wall to bounce-pass to another player or back to themselves. The wall may comprise of a transparent plastic portion 132, similar to walls used in a hockey arena. In FIG. 1, the transparent portion 132 is shown partially broken away, for illustrative clarity. Wall 130 is preferably between about six to twelve feet high including both transparent upper portion 132 and opaque lower portion 134. In addition, netting (not shown) may be strung above the top of the wall to prevent balls (and given the aerial aspects of the game, perhaps even an occasional flying player) from passing into the crowd. The wall and the absence of sidelines may be used advantageously to eliminate most stoppages in the game due to out-of-bounds violations. In an embodiment of the invention, the baselines (boundaries along the short edges of a rectangular court) are retained. In addition, a padded area 128 may be provided adjacent to an area underneath the elevated goals, between the wall and baselines (outside of the in-bounds area) to protect players in the event of a fall from the deformable-elastic surfaces. Further in addition, portions of the elevated goal and its support structure may be padded. Suitable doors 126 are preferably provided in the wall for entry and exit of players.

Figure 3:
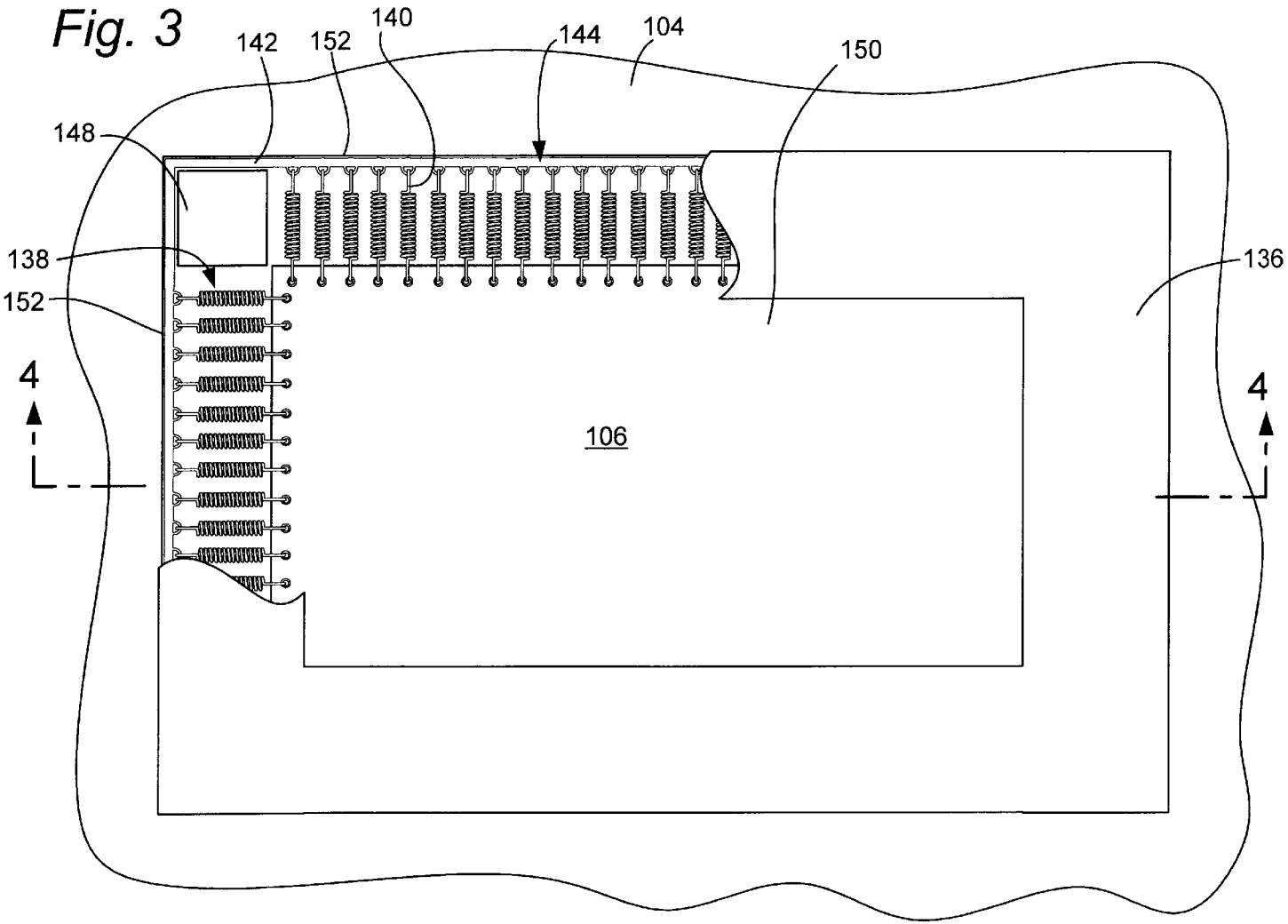
FIG. 3 is a plan view showing exemplary adjacent portions of the rigid and deformable-elastic playing surfaces.

A more detailed plan view of an exemplary deformable-elastic surface 106 provided by a trampoline 144 is shown in FIG. 3. Trampoline 140 comprises a peripheral frame 142, a sheet of heavy durable fabric 150 comprising surface 106, and an array of tension springs 138 around the periphery of sheet 150. Frame 142 is constructed using any suitable structural shape, such as angle or tubular steel. Selection and arrangement of individual springs 140 to form the array 138 in conjunction with the frame 142 may be done as known in the trampoline arts. In an embodiment of the invention, the frame 142 is secured directly to, or closely adjacent to, edges 152 of a hole in the resilient surface 104. In the alternative, the frame 142 may be supported independently of the resilient surface 104, such as by being supported by a structural frame resting on an underlying floor. A filler pad 148 may be mounted to or adjacent to frame 142 to fill any gaps in the spring array that are large enough to step through, such as may occur at the corners of a rectangular trampoline. The entire spring array 138, filler pads 148, and frame 142 are preferably covered by a durable cushioned pad 136. Pad 136 may be comprised of two or more separable pieces, and is preferably held in position over the spring array 138 using a removable method such as ties or hook-and-loop fasteners.

Figure 4:
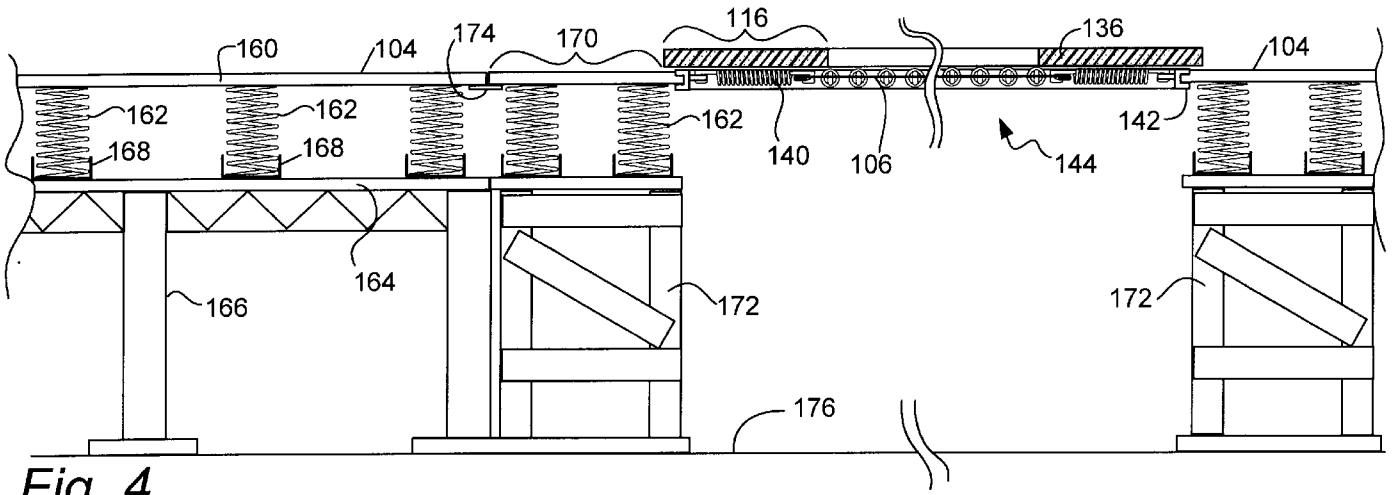
FIG. 4 is cross-sectional view showing the exemplary adjacent portions of the rigid and deformable-elastic playing surfaces of FIG. 3.

FIG. 4 shows a cross-sectional view of an exemplary trampoline 144 and surrounding areas of resilient surface 104, according to an embodiment of the invention wherein the resilient surface is comprised of a resiliently suspended floor 160. Floor 160 may be comprised of any suitable rigid floor material suspended above or from a flooring frame 166 above the bottom floor or base 176 of the arena or other location where the game court is to be erected. For example, flooring frame 166 may comprise a stage frame, as known in the theater arts, supporting a subfloor 164. Sections of the floor 160 may then be suspended above the subfloor 164 by a regularly spaced array of compression springs 162. Selection and arrangement of the compression springs may be as known in the engineering arts, once the desired resilient response characteristics of the floor 160 are defined as set forth herein.

Floor 160 may be resiliently suspended in various ways. For example, the sections of floor may be spliced together at their edges, such as by splice 174, or in the alternative, may be allowed to move independently. Other types of resilient elements may be used instead of compression springs to suspend floor 160, such as, for example, torsion bars or leaf springs. In addition, it is also within the scope of the invention to suspend floor 160 in any other suitable manner, such as by direct suspension from a frame without the use of a subfloor. However, the subfloor/spring suspension method advantageously is relatively easy to assemble, maintain, and disassemble, and is readily capable of providing a playing surface 104 suitable for supporting basketball-style play with uniform and tunable resilient response characteristics over its entire surface.

However it is constructed, floor 160 preferably has substantially uniform resilient response characteristics over its entire surface. The response characteristics of surface 160 are preferably tuned so that the surface will absorb relatively little energy from collisions with light elastic objects such as basketballs or from reactions to the feet of standing, jumping, or running players, and relatively greater energy from collisions with heavier inelastic objects such as falling players. Thus, floor 160 is preferably constructed so as to not unduly suppress the bouncing or dribbling of a basketball or other elements of basketball-style play, while still preventing injuries from falling players by absorbing a substantial portion of their kinetic energy and cushioning their fall.

For the embodiment shown in FIG. 4, the energy-absorptive characteristics of floor 160 depend primarily on the stiffness of the flooring materials and cumulative deflection characteristics of its supporting coil springs 162. One skilled in the engineering arts may design a suitable combination to achieve the desired characteristics. For example, where floor 160 is constructed from adjoining panels of ¾ inch thick plywood, it has been found suitable to evenly distribute the compression springs under floor 160 spaced about twelve inches apart on center, wherein each compression spring is about eight inches long, has a four inch range of compressibility, and a spring constant from between about 30 to 300 pounds per inch, and more preferably between about 100 to 150 pounds per inch. Each spring 162 is attached to the plywood floor 160 and removably retained by a sleeve 168 on subfloor 164. However, many other combinations may also be suitable, and the exemplary configuration is not necessarily optimal.

Springs of various types, sizes, spring constants, and spacing may be experimented with to achieve a resilient surface with the desired properties. Although mechanical springs provide the advantages of simplicity and relatively low cost, the invention is not limited to use of mechanical springs. Other shock-absorbing mechanisms, for example, hydraulic or pneumatic shock absorbers, may be placed in series or parallel with the mechanical springs, or used to replace the mechanical springs entirely. Furthermore, the response characteristics of active suspension elements may dynamically controlled, for example, by controlling the fluid pressure of an array of shock absorbers. One skilled in the art may devise numerous alternative suspension and control mechanisms.

Using the foregoing resiliently suspended floor 160, some energy will be absorbed from the game ball with each bounce. Therefore, according to an embodiment of the invention, the coefficient of restitution of the game ball is preferably increased to compensate for the energy absorbed by the floor, so that the handling characteristics of the original ball (such as a basketball) may be maintained. The coefficient of restitution is defined as the fraction of energy retained by the ball after a collision with a perfectly hard object. For example, a regulation basketball when dropped from a height of ten feet onto a rigid resilient floor will rebound to a height of seven feet on the first bounce, and is therefore said to have a coefficient of restitution of 0.70. For use with floor 160, a ball with a higher coefficient of restitution, such as, for example, about 0.85, has been found preferable. The higher coefficient of restitution enables the ball, when used on a resiliently suspended floor, to bounce similarly to a traditional basketball on a rigid floor. The coefficient of restitution of a traditional basketball may be increased by over-inflating the ball. However, inflating a basketball to achieve this restitution value will make the ball quite hard. Accordingly, it is preferable to select a ball with a relatively soft cover, such as, for example, the Wilson™ Jet Evolution™ basketball.

A section 170 of floor 160 adjacent to each trampoline 144 is preferably supported by trampoline support frame 172. The trampoline support frame is generally of heavier construction than the subfloor frame 166 elsewhere under floor 160, to support the trampoline and isolate it from adjoining areas of the subfloor frame. For a seamless connection to the resilient surface 104, the trampoline edge frame is preferably attached to the resiliently supported section 170. Attaching to a resilient portion of the floor structure (instead of to a rigid member like frame 172) advantageously provides an energy-absorptive edge surrounding the trampoline area, which can be important for preventing injuries to players. At the same time, however, section 170 should be supported firmly enough so that the section and the attached trampoline remain acceptably stable during heavy use of the trampoline. Accordingly, it may be desirable to decrease the spacing between adjacent springs 162 under section 170, to use stiffer springs in this area, to attach section 170 to frame 172 using flexible steel cables (not shown) thereby restraining upward deflection of the section, or some combination of the foregoing. In the alternative, other configurations of resilient frame support structures may be used, without departing from the scope of the invention.

Figure 5:
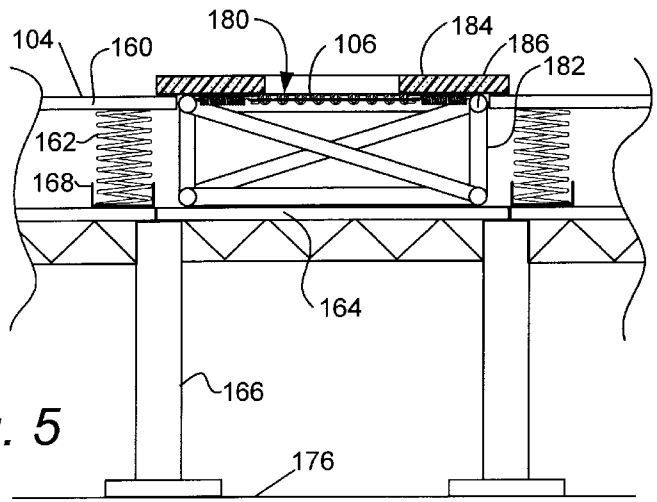
FIG. 5 is a cross-sectional view showing an alternative construction for a deformable-elastic playing surface adjacent to a resilient surface.

For relatively small areas of deformable-elastic surface 106, such as, for example, areas 124*a–b* shown in FIG. 2, a mini-trampoline 180 may be placed directly on and attached to the subfloor 164, as shown in FIG. 5. Mini-trampolines are commercially available appropriately tuned for applications such as for gymnastics launch pads, making them suitable for launching into the primary deformable-elastic areas 120*a–b,* shooting jump shots, shot blocking, and the like. However, because of their relatively small size, mini-trampolines generally are not capable of launching players as high as larger trampolines designed for acrobatic use. The mini-trampoline typically has a relatively short frame 182 that will fit in the space between floor 170 and subfloor 164. The edge frame 186 of the mini-trampoline 180 is typically not resiliently supported, unlike edge frame 142 of trampoline 144, and therefore the mini-trampoline 180 is preferably not located in a position where players are likely to land after launching from a trampoline. In the alternative, the mini-trampoline may be supported in a manner similar to that shown in FIG. 4 and previously described. The edge frame 186 and springs of the mini-trampoline 180, like trampoline 144, are preferably covered by a cushioned pad 184.

Figure 6:
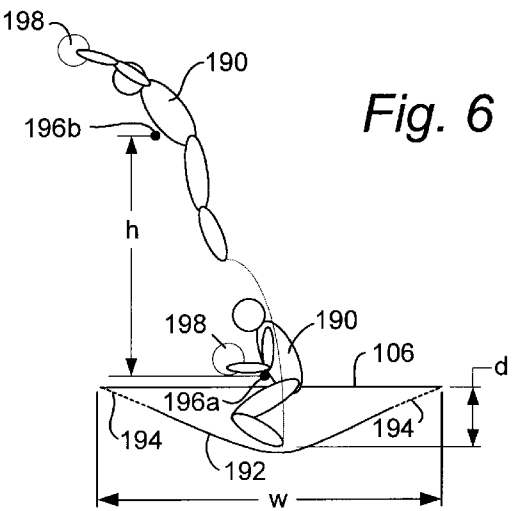
FIG. 6 is a schematic diagram illustrating exemplary aspects of a deformable-elastic surface.

Referring to FIG. 6, exemplary aspects of a deformable-elastic surface 106 according to the present invention are illustrated. The horizontal line indicated by the numeral 106 shows the position of the surface when at rest, and the curved line 192 indicates an exemplary shape of the surface at a point of maximum deformation after receiving a falling player 190 holding a ball 198. The dotted lines 194 show the amount of stretch, such as provided by tension springs on a trampoline, needed for providing the deformed shape 194. The position of the player's centroid of mass while on the surface 106 at the bottom of its downward stroke is indicated by the dark circle 196*a*. If suitably tuned for propelling the player upwards, the surface 106 will be deformed a substantial distance d from its resting position, wherein the distance d is a substantial portion, as at least about one-tenth, and more preferably at least about one-fourth, of the height of player 190. Furthermore, the ratio d/w, where w is the span of the surface in its resting position, is preferably greater than at least about one-tenth, and more preferably at least about one-fourth, thereby avoiding the need for excessively large deformable-elastic surfaces tuned to respond to the players' bodies. After being deformed, the deformable-elastic surface strokes upward. During the upstroke, the player pushes off, propelling his centroid of mass upwards a distance h to the upper position 196*b*. The player is propelled upwards substantially higher than the player can jump from a traditional rigid surface, such as more than about 1.5 times higher. Still greater elevation of the ball 198 may be achieved by extension of the player's body.

The game court 100 is especially useful for playing games modeled according to the essential rules of basketball, with certain modifications to increase the intensity and excitement of the game, although the game court and particularly, the playing surface 102, are not limited to use with basketball-type games. Rules of basketball, as exemplified by the rules described in the book titled "The Official Rules of the National Basketball Association, 1999–2000," ISBN 0892046198, are well-known. In an embodiment of the invention, a game is played on the game court according to rules of basketball, modified by adoption of any combination of the following rules. According to the invention, there is no stoppage of the game on account of rule violations or fouls, and no "free throws". Instead, a specified number of points are immediately awarded to the team against whom the foul is committed. Similar to hockey, players may be ejected for specified periods for flagrant fouls, forcing their team to play short-handed during the penalty period. For less flagrant fouls, the offender and the fouled player may face each other in a one-on-one attempt at a goal, analogous to a penalty shot in soccer or hockey. The "possession arrow" is generally not used, and players are permitted to more aggressively wrest the ball from the possession of an opposing player. Body contact is more liberally allowed, particularly in the second court areas having the deformable-elastic surface. Players are not permitted to linger on the deformable-elastic surfaces, such as by permitting only a specified number of bounces on the elastic surface before the player must leave. For example, the specified number of bounces may be a relatively low number, such as one or two. The game clock is generally not stopped during a period of play, and the "shot-clock" period, during which a team in possession of the ball must attempt a goal, is relatively short. Player substitutions are liberally allowed without stoppage of the game. Zone defensive schemes are generally not allowed. Each of the foregoing rules may be used, individually or in various combinations, to create a more intense, fast-moving, and exciting game in combination with the special game court disclosed herein.

It is further anticipated that certain of the rules described herein may also be adapted to increase the pace and excitement of a game played entirely on a hard, substantially rigid surface, such as on prior art basketball courts. In general, the invention is especially useful for attracting and retaining a loyal audience of spectators, especially when a game according to the invention is played on the special game court. It is desirable, therefore, to broadcast and/or to record games played on the game court for consumption by a geographically remote audience. Methods for broadcasting basketball games in various media, such as, for example, television, radio, and internet media, are known in the art. Such methods may be readily adapted to broadcast a game played on the game court by one skilled in the art.

Having thus described a preferred embodiment of game court and game played thereon, it should be apparent to those skilled in the art that certain advantages of the within system have been achieved. It should also be appreciated that various modifications, adaptations, and alternative embodiments thereof may be made within the scope and spirit of the present invention. For example, a specific configuration of game court has been illustrated, but it should be apparent that the inventive concepts described above would be equally applicable to any game court with an elevated goal and adjacent areas of deformable-elastic and hard playing surfaces. For further example, new rules for governing play on the special game court have been disclosed, but the invention is not limited by the specific rules disclosed. The resilient and deformable-elastic playing surface of the present invention may even be adapted for use with other sports, for example, gymnastics or exhibition-style wrestling, within the scope of the invention. The invention is further defined by the following claims.

What is claimed is:

1. A game court for a ball game using at least one elevated goal, the game court comprising a playing surface comprised of a hard planar surface substantially coplanar to a deformable-elastic planar surface, the hard planar surface and the deformable-elastic planar surface defining an in-bounds area, the deformable-elastic planar surface being positioned within the in-bounds area, and the at least one elevated goal being positioned above the hard planar surface and adjacent to or within the in-bounds area, wherein the hard planar surface is hard enough to permit bouncing of a pressurized game ball in a fashion substantially like that of basketball;

said in-bounds area has substantially the same dimensions as the dimensions of a regulation basketball court.

2. The game court according to claim 1, wherein the hard planar surface comprises at least half of the playing surface.

3. The game court according to claim 1, wherein the deformable-elastic surface is located adjacent to an area underneath the at least one elevated goal.

4. The game court according to claim 1, wherein the deformable-elastic surface comprises at least one trampoline.

5. The game court according to claim 4, wherein the at least one trampoline is suspended from the hard planar surface by an array of springs.

6. The game court according to claim 5, wherein the array of springs is covered by a pad.

7. The game court according to claim 4, wherein the at least one trampoline is suspended from the hard planar surface by a plurality of elastic straps.

8. The game court according to claim 1, wherein the deformable-elastic surface is divided into at least two separate areas by the hard planar surface.

9. The game court according to claim 1, further comprising a padded area adjacent to an area underneath the at least one elevated goal and outside of the in-bounds area.

10. The game court according to claim 1, further comprising a wall around at least a portion of a perimeter of the in-bounds area.

11. The game court according to claim 10, wherein the wall encloses substantially all of the game court.

12. The game court according to claim 11, wherein the wall encloses the in-bounds area and an area outside of the in-bounds area.

13. The game court according to claim 10, wherein the wall comprises a transparent upper portion.

14. The game court according to claim 10, wherein the wall comprises a substantially resilient surface extending over substantially all of an interior side of the wall facing the game court.

15. The game court according to claim 1, wherein the in-bounds area is rectangular and bounded by two opposing sides and two opposing ends.

16. The game court according to claim 15, further comprising a wall along the two opposing sides.

17. The game court according to claim 15, wherein the at least one elevated goal further comprises a first one elevated goal located at a first one of the two opposing ends, and a second one elevated goal located at a second one of the two opposing ends.

18. The game court according to claim 1, wherein the hard planar surface further comprises markings formed on the hard planar surface, the markings defining a bounce area and the deformable-elastic planar surface being positioned within the bounce area.

19. The game court according to claim 1, wherein the resilient elements further comprise at least one of compression springs, torsion bars and leaf springs.

20. A game court for a ball game using at least one elevated goal, the game court comprising a playing surface comprised of a deformable-elastic planar surface substantially coplanar to a resiliently suspended floor, the resiliently suspended floor comprising a hard planar surface supported by resilient elements, the resiliently suspended floor and the deformable-elastic planar surface defining an in-bounds area, the deformable-elastic planar surface being positioned within the in-bounds area, and the at least one elevated goal being positioned above the resiliently suspended floor and adjacent to or within the in-bounds area, wherein the hard planar surface is hard enough to permit bouncing of a pressurized game ball in a fashion substantially like that of basketball.

21. A game court for a ball game using at least one elevated goal, the game court comprising a playing surface comprised of a hard planar surface substantially coplanar to a deformable-elastic planar surface, the hard planar surface further comprising a resiliently suspended floor that is suspended by an array of coil springs over a subfloor, the hard planar surface and the deformable-elastic planar surface defining an in-bounds area, the deformable-elastic planar surface being positioned within the in-bounds area, and the at least one elevated goal being positioned above the hard planar surface and adjacent to or within the in-bounds area, wherein the hard planar surface is hard enough to permit bouncing of a pressurized game ball in a fashion substantially like that of basketball.

22. A game court for a ball game using at least one elevated goal, the game court comprising a playing surface comprised of a hard planar surface substantially coplanar to a deformable-elastic planar surface, the hard planar surface further comprising a resiliently suspended floor that comprises at least two layers of flooring material, the hard planar surface and the deformable-elastic planar surface defining an in-bounds area, the deformable-elastic planar surface being positioned within the in-bounds area, and the at least one elevated goal being positioned above the hard planar surface and adjacent to or within the in-bounds area, wherein the hard planar surface is hard enough to permit bouncing of a pressurized game ball in a fashion substantially like that of basketball.

* * * * *